US006079075A

United States Patent [19]

Velez-Juan

[11] Patent Number: 6,079,075

[45] Date of Patent: Jun. 27, 2000

[54] TOOTHBRUSH WITH IMPROVED HANDLE AND DETACHABLE BRISTLED CARTRIDGE

[76] Inventor: Diego R. Velez-Juan, D-6 Park Pl. St., Urb. Torrimaiz Estates, Guayhabo, Puerto Rico 00969

[21] Appl. No.: 09/107,473

[22] Filed: Jun. 30, 1998

Related U.S. Application Data

[60] Provisional application No. 60/054,154, Jul. 29, 1997.

[51] Int. Cl.[7] ..... A46B 7/04

[52] U.S. Cl. ..... 15/167.1; 15/176.6; 15/145; 15/143.1

[58] Field of Search ..... 15/167.1, 176.1, 15/176.6, 145, 144.1, 194, 202, 143.1

[56] References Cited

U.S. PATENT DOCUMENTS

| | | |
|---|---|---|
| D. 307,207 | 4/1990 | Wolf . |
| 1,908,511 | 5/1933 | Dodson . |
| 2,277,682 | 3/1942 | Brighton . |
| 3,010,131 | 11/1961 | Kisky . |
| 3,067,446 | 12/1962 | McGauley . |
| 3,879,139 | 4/1975 | Dahl et al. . |
| 4,030,845 | 6/1977 | Deckert . |
| 4,227,276 | 10/1980 | Ginsburg . |
| 4,362,174 | 12/1982 | Baker et al. . |
| 4,890,349 | 1/1990 | Nitzsche . |
| 4,890,732 | 1/1990 | Shackelford . |
| 5,228,166 | 7/1993 | Gomez . |
| 5,247,716 | 9/1993 | Bock . |
| 5,511,276 | 4/1996 | Lee . |
| 5,564,152 | 10/1996 | Jeannet et al. . |
| 5,737,792 | 4/1998 | Quigless . |

FOREIGN PATENT DOCUMENTS

| | | |
|---|---|---|
| 0083787 | 7/1983 | European Pat. Off. . |
| 2272631 | 5/1994 | United Kingdom . |
| WO 93/07778 | 4/1993 | WIPO . |

*Primary Examiner*—Robert J. Warden, Sr.
*Assistant Examiner*—Jennifer C. McNeil
*Attorney, Agent, or Firm*—Richard C. Litman

[57] ABSTRACT

The present invention is directed towards an improved detachable head toothbrush which is simply constructed, easy to use, and includes features to promote a proper brushing technique. The handle includes a pair of deformable rigid tangs having outward extensions for engaging a corresponding surface in an interior passage through the bristle cartridge. The handle also includes a series of thumb depressions to assist in positioning the bristles over a tooth.

8 Claims, 3 Drawing Sheets

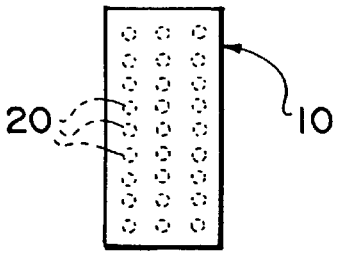
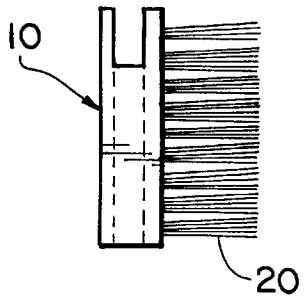
FIG. 1
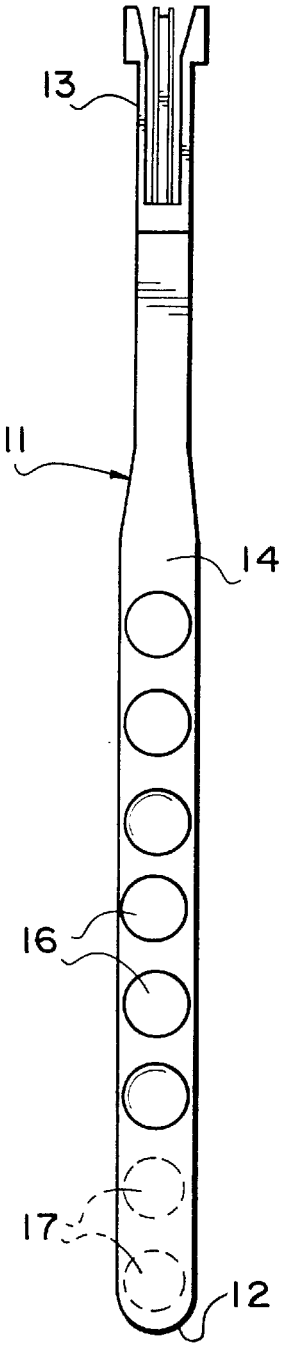
FIG. 2
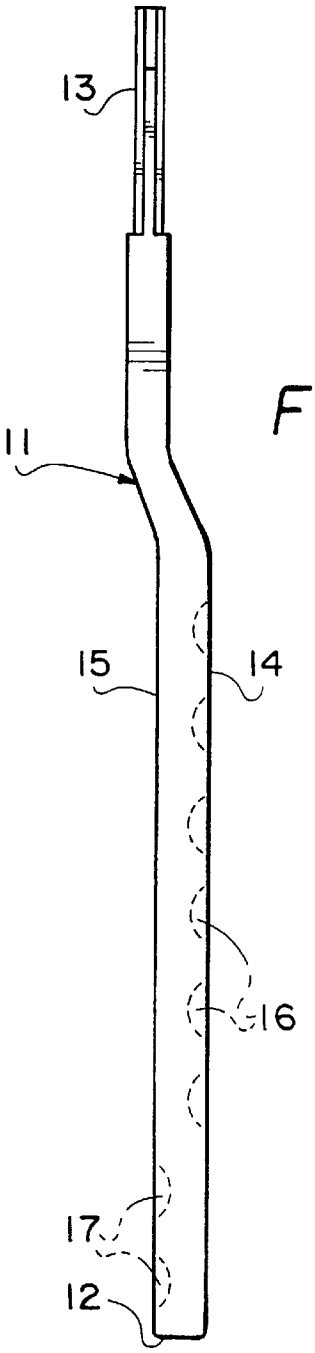

TOOTHBRUSH WITH IMPROVED HANDLE AND DETACHABLE BRISTLED CARTRIDGE

CROSS-REFERENCE TO RELATED APPLICATION

This application claims the benefit of U.S. Provisional Patent Application Ser. No. 60/054,154, filed Jul. 29, 1997.

BACKGROUND OF THE INVENTION

1. Field of the Invention

The present invention relates to dental care products and more specifically to toothbrushes with specially designed handles and disposable bristled cartridges.

2. Description of Related Art

The need for effective and regular dental care to prevent tooth decay and/or periodontal disease is well recognized. It is also recognized that in order to be effective, a program of dental care should include a daily regimen of brushing. In order to be effective, the brushing must be carried out with an effective and proper toothbrush having bristles which are not excessively worn or frayed. In this connection, it has been found that the bristles of even a high quality toothbrush can become worn or frayed after several weeks of normal use and that therefore even a high quality toothbrush should be replaced after approximately one month's use. It has also been found that a toothbrush should be replaced whenever the user thereof has had any type of illness in order to avoid infecting the user's gums during subsequent brushing.

While the general concept of providing a toothbrush having a replaceable brush cartridge has been previously known, the previous attempts to construct toothbrushes of this type have generally been commercially unsuccessful for various practical reasons. Particularly, the previous inventions for toothbrushes with replaceable bristle cartridges have employed one of two designs. In one design the cartridges are frictionally attached to the toothbrush handle. With this design, the cartridge will either be insecurely attached, prone to becoming disconnected from the handle while in use; or the cartridge will be too securely attached, requiring a user to exert excessive force to attach or disconnect the cartridge. Some of the known frictional-attachment designs even require special tools for replacement of the cartridge. In the second typical design, the attached cartridge is secured to the toothbrush handle with one of various securing means to prevent inadvertent disconnection. However, these designs are complex and require excessive moving parts, such as compression springs, screws or pins. Moreover, some of these securing means are not disposed flush with the toothbrush handle and can cause trauma to oral tissues.

For example, U.S. Pat. No. 4,030,845 issued June 1997 to Deckert discloses a toothbrush with self-contained dentifrice and having a disposable handle. The invention, directed primarily to the inclusion of dentifrice, discloses attaching the bristle cartridge to the handle either with an adhesive, or alternatively, by a pair of clips which frictionally receive the bristle cartridge. The invention does not disclose any locking means to ensure that the head does not become disconnected from the handle.

U.S. Pat. No. 4,227,276 issued October 1980 to Ginsberg et al. discloses a toothbrush with a thermally deformable handle. The invention employs special pins which must be inserted into the bristle handle to release the securing hooks of the bristle cartridge. It also includes a handle made out of a deformable material which can be selectively angled or twisted by a user. Thus, this invention is more complicated than the instant invention and requires additional moving parts.

U.S. Pat. No. 4,890,349 issued January 1990 to Nitzsche discloses a toothbrush with replaceable bristle insert. The insert snaps into the groove of a deformable plastic toothbrush head. Repeated deformation of the head's groove ledges, required for replacement of the insert, may compromise the integrity of the ledges so that the insert is not held securely within the head.

U.S. Pat. No. 4,890,732 issued January 1990 to Shackelford discloses a toothbrush with a disposable bristle cartridge. The bristle cartridge frictionally slides onto the handle, but contains no means for locking the cartridge into place.

U.S. Pat. No. 5,228,166 issued July 1993 to Gomez discloses a removable head toothbrush in which the head is pivotally connected to the handle. This complicated design includes compression springs and pins and does not lend itself to proper brushing technique.

U.S. Pat. No. 5,247,716 issued September 1993 to Bock discloses an ultrasonic toothbrush with a removable brushhead. Removal of the brush head is difficult as it requires that the user either apply significant axial pulling force, or alternatively use a wedge shaped tool to pry the head off of the handle. Replacement of the cartridge of the present invention does not require excessive force or special tools.

U.S. Pat. No. 5,511,276 issued April 1996 to Lee discloses a toothbrush with a replaceable bristle cartridge. The invention employs a special releasing pin and spring in the bristle handle which must be depressed to release the locking tooth of the bristle cartridge. U.S. Pat. No. 5,564,152 issued October 1996 to Jeannet et al. discloses a toothbrush with a removable bristle cartridge. The bristle cartridge is replaced by screwing it onto a spring-loaded pre-stressed pin secured within the handle. Thus, these inventions are more complicated than the instant invention and require additional moving parts.

European Pat. No. 0 083 787 issued July 1983 to Lang et al. (Zahnbürste mit einem auswechselbaren Bürstenkopf) discloses a toothbrush with a detachable bristle head. The bristle head retaining means comprises a metal tongue extending from the handle. The metal tongue has a hole passing therethrough which receives a detent disposed on the surface of the inner chamber of the bristle head for frictional connection therewith. The invention does not disclose the inclusion of a locking means to ensure that the portions do not become separated.

P.C.T. Pat. App. No. WO 93/07778 issued April 1993 to Hodosh et al. discloses a toothbrush with a replaceable tip portion. The cartridge head retaining means comprises detent means which releasably retain the projection of either the head or handle portion of the toothbrush in engagement in the cavity of the other portion. The frictional retaining means of the invention does not disclose the inclusion of a locking means to ensure that the portions do not become separated.

U.K. Pat. App. No. 2 272 631 issued May 1994 to Woo discloses a toothbrush comprising a removable head, a handle and a washer. The removable head is attached to the handle in one of two methods. One method entails screwing the head onto the handle until a pair of pointers disposed on the two parts are aligned. No means are disclosed to prevent the head from rotating out of alignment during brushing. In an alternate push-fit embodiment, the handle recess includes a notch ridge which frictionally engages the head protrusion.

The invention does not disclose the inclusion of a locking means to ensure that the portion do not become separated.

Moreover, none of these inventions include a handle having specially spaced thumb and finger depressions which promote proper brushing technique. Thus, a need exists for a simply designed toothbrush having a removable bristle cartridge which securely locks in place for use and further having a handle designed to promote proper brushing technique. None of the above inventions and patents, taken either singly or in combination, is seen to describe the instant invention as claimed.

SUMMARY OF THE INVENTION

The present invention is directed towards an improved detachable head toothbrush which is simply constructed, easy to use, and includes features to promote a proper brushing technique. The improvements include an improved toothbrush handle and an improved detachable bristled cartridge.

The toothbrush handle, while shaped similarly to conventional handles, includes features which enable improved manipulation and control of the toothbrush. Particularly, the top surface of the toothbrush handle possesses six axially interspaced thumb depressions. Each depression has a diameter of approximately 10 mm. and a depth of approximately 2 mm. The distance between any two adjacent depressions is approximately 4 mm. The diameter and depth of the thumb depressions are designed for more comfortable gripping, to enable improved manipulation and control of the toothbrush. The depressions are spaced upon the handle at a unit distance equal to the distance on center from one tooth to an adjacent tooth.

In use, by holding the hand and brush in the same distance from the mouth and moving the thumb from one depression to an adjacent depression, the user can move the toothbrush the necessary unit distance from alignment with one tooth to alignment with an adjacent tooth, thereby pinpointing the bristled cartridge over a tooth for proper execution of an up and down brushing motion without moving the user's hand in a back and forth motion. This is preferable because brushing in a back and forth motion causes erosion trauma to the tooth at the gumline and gingival recession. Gingival recession is one cause of temperature sensitivity in the teeth.

Additionally, the bottom surface of the toothbrush handle possesses two axially interspaced finger depressions, disposed rearwardly of the thumb depressions. These finger depressions provide better gripping by the fourth and fifth fingers, improving the user's stability in controlling the toothbrush. The finger depressions also enable greater control while the user is brushing molars and wisdom teeth in the rearward portions of the mouth.

The second improvement of the present invention relates to the improved locking means for releasably securing a detachable bristled cartridge to the toothbrush handle. The locking means holds the cartridge on the toothbrush handle securely, but does not require additional parts such as springs or pins, and does not require the user to exert excessive energy when changing the cartridge.

The bristled cartridge comprises a generally rectangular housing having a first end, a second end and an interior passage running therebetween. The interior passage has a top passage surface, a bottom passage surface and a pair of opposing side passage surfaces. The top and bottom passage surfaces each have an interiorally protruding ridge disposed between the pair of opposing side passage surfaces. The two protruding ridges extend from the first end to the second end. The pair of opposing side passage surfaces extend from the first end to a preselected distance between the first end and the second end. Each side passage surface has an interiorally protruding vertical lip portion which extends from the top passage surface to the bottom passage surface. Each vertical lip portion has an interiorally angled surface generally facing the first end of the housing and further has an interiorally extending locking surface extending normal to the side passage surface and facing the second end of the housing.

The attachment end of the toothbrush handle further comprises an H-shaped guide positionally disposed between a pair of deformably rigid tangs. The H-shaped guide is sized to receive the interiorally protruding ridges of the top and bottom passage surfaces of the bristle cartridge. The attachment end further includes locking means for releasably securing the attached bristled cartridge in position on the toothbrush handle.

The locking means are incorporated into the pair of deformably rigid tangs disposed upon the attachment end of the toothbrush handle. The deformably rigid tangs are biased in laterally spaced opposition. Each tang has a tip possessing an outwardly extending locking surface sized and disposed for mating with one of the interiorally extending locking surfaces of the side passage surface vertical lip portions. The pair of deformably rigid tangs are also sized for and movable between a depressed position and a biased locking position.

Thus, the deformably rigid tangs may be depressed by a user for passage of the attachment end through the first end of the interior passage of the bristled cartridge. When the deformably rigid tangs are released to the biased locking position, the deformably rigid tangs releasably secure the attached bristled cartridge in position upon the attachment end of the toothbrush handle. It is highly preferable if the H-shaped guide and the pair of deformably rigid tangs are pre-sized to be disposed in flush alignment with the second end of the bristled cartridge when the cartridge is attached to the attachment end of the toothbrush handle to prevent trauma to oral tissue.

Accordingly, it is a principal object of the invention to provide a toothbrush with an improved handle including features which promote a proper brushing technique.

It is another object of the invention to provide an improved toothbrush of the type having a detachable bristled cartridge.

It is a further object of the invention to provide an improved toothbrush of the type having a detachable bristled cartridge including locking means for releasably securing the attached bristled cartridge in position on the toothbrush handle.

Still another object of the invention is to provide an improved toothbrush of the type having a detachable bristled cartridge which does not require the use of springs, pins or additional moving parts.

It is an object of the invention to provide improved elements and arrangements thereof in an apparatus for the purposes described which is inexpensive, dependable and fully effective in accomplishing its intended purposes. These and other objects of the present invention will become readily apparent upon further review of the following specification and drawings.

BRIEF DESCRIPTION OF THE DRAWINGS

FIG. 1 is an exploded top view of the bristled cartridge and the toothbrush handle according to the present invention.

FIG. 2 is an exploded side view of the bristled cartridge and the toothbrush handle according to the present invention.

Similar reference characters denote corresponding features consistently throughout the attached drawings.

DETAILED DESCRIPTION OF THE PREFERRED EMBODIMENT

Figure 3:
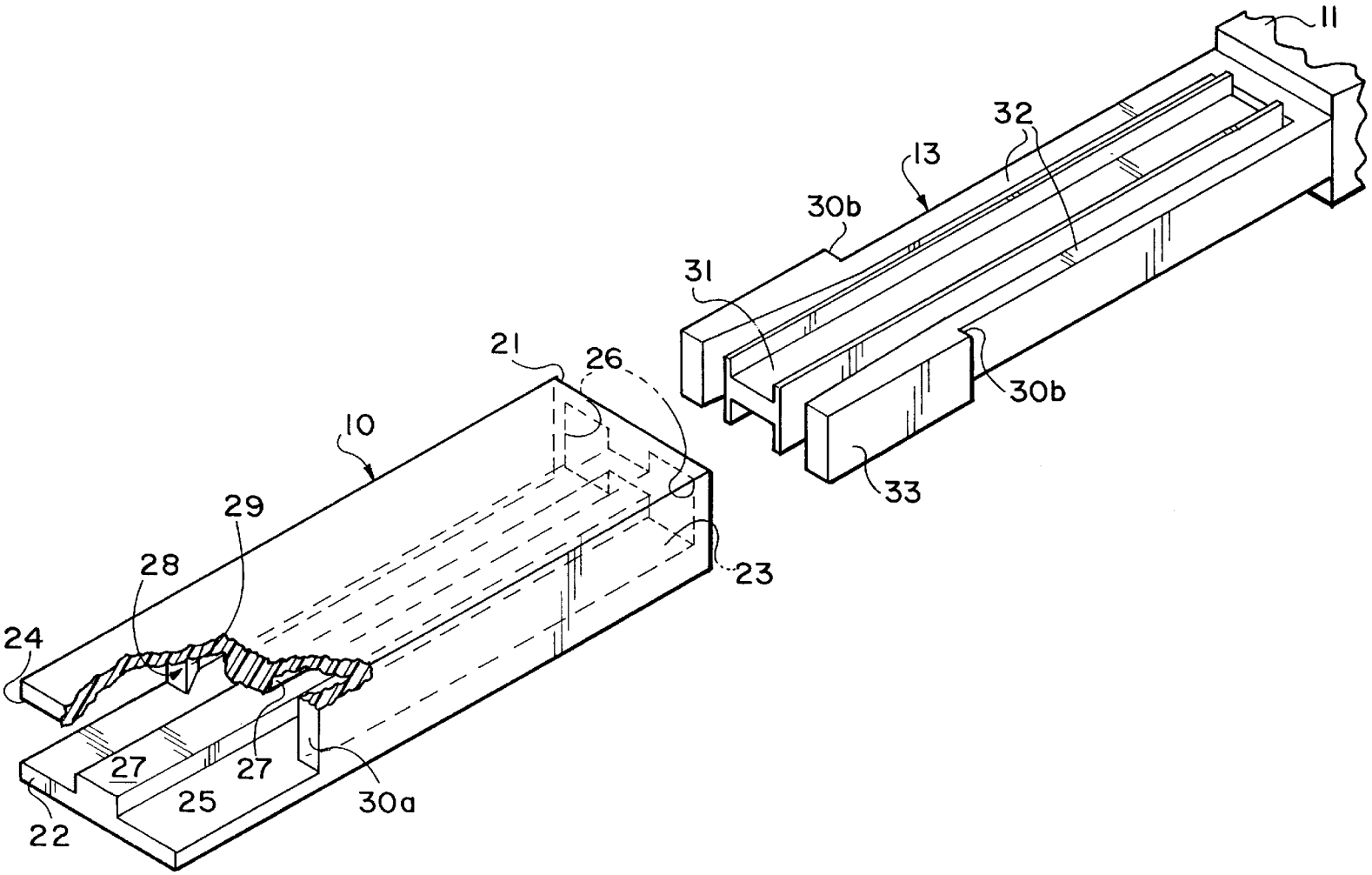
FIG. 3 is an exploded perspective cutaway view of the attachment end of the toothbrush handle and the bristled cartridge depicted without the bristles.

The present invention is directed towards an toothbrush having a detachable bristled cartridge and an improved handle for promoting proper brushing technique. FIG. 1 and FIG. 2 are an exploded top view and side view, respectively, of the bristled cartridge 10 and the toothbrush handle 11 according to the present invention. The toothbrush handle 11 has a rear end 12, an attachment end 13, a top handle surface 14, and a bottom handle surface 15. The top handle surface 14 possesses a plurality of thumb depressions 16 spaced apart by a predetermined unit distance to enable the user to move the toothbrush from one tooth to another without moving the hand in a back and forth motion, for promoting proper brushing technique. By holding the hand and brush in the same distance from the mouth and moving the thumb from one depression 16 to an adjacent depression 16, the user can move the toothbrush the necessary unit distance from alignment with one tooth to alignment with an adjacent tooth, thereby pinpointing the bristled cartridge over a tooth for proper execution of an up and down brushing motion without moving the user's hand in a back and forth motion.

Preferably, each depression 16 has a diameter of approximately 10 mm. and a depth of approximately 2 mm. The distance between adjacent depressions 16 is approximately 4 mm. These dimensions maximize both the gripping comfort and the usefulness of the depressions 16 to guide the user in properly positioning the brush over a tooth.

The bottom handle surface 15 possesses two finger depressions 17 rearward of the thumb depressions 16 to provide better balance and gripping for promoting proper brushing technique. FIG. 1 and FIG. 2 also generally show the bristles 20 disposed upon the bristled cartridge 10.

FIG. 3 is an exploded perspective cutaway view of the attachment end 13 of the toothbrush handle 11 and the bristled cartridge 10 depicted without the bristles according to the present invention. The bristled cartridge 10 comprises a generally rectangular housing having a first end 21, a second end 22 and an interior passage 23 running therebetween. The interior passage 23 has a top passage surface 24, a bottom passage surface 25 and a pair of opposing side passage surfaces 26. The top and bottom passage surfaces 24,25 each have an interiorally protruding ridge 27 disposed between the pair of opposing side passage surfaces 26 which extend from the first end 21 to the second end 22. The pair of opposing side passage surfaces 26 extend from the first end 21 to a preselected distance between the first end 21 and the second end 22.

Each side passage surface 26 has an interiorally protruding vertical lip portion 28 which extends from the top passage surface 24 to the bottom passage surface 25. Each vertical lip portion 28 has an interiorally angled surface 29 generally facing the first end 21 of the housing and further has an interiorally extending locking surface 30*a* extending normal to the side passage surface 26 and facing the second end 22 of the housing.

The attachment end 13 of the toothbrush handle 11 further comprises an H-shaped guide 31 positionally disposed between a pair of deformably rigid tangs 32. The H-shaped guide 31 is sized to receive the interiorally protruding ridges 27 of the top and bottom passage surfaces 24,25 of the bristle cartridge 10. The attachment end 13 further includes locking means for releasably securing the attached bristled cartridge 10 in position on the toothbrush handle 11.

The locking means comprises a pair of deformably rigid tangs 32 disposed upon the attachment end 13 of the toothbrush handle 11. The deformably rigid tangs 32 are biased in laterally spaced opposition. Each tang 32 has a tip 33 possessing an outwardly extending locking surface 30*b* sized and disposed for mating with one of the interiorally extending locking surfaces 30*a* of the side passage surface 26 vertical lip portions 28. The pair of deformably rigid tangs 32 are also sized for and movable between a depressed position and a biased locking position.

Thus, the deformably rigid tangs 32 may be depressed by a user for passage of the attachment end 13 through the first end 21 of the interior passage 23 of the bristled cartridge 10. When the deformably rigid tangs 32 are released to the biased locking position, the deformably rigid tangs 32 releasably secure the attached bristled cartridge 10 in position upon the attachment end 13 of the toothbrush handle 11.

Preferably, the tabs 32 are sized to be in flush alignment with the second end 22 when in the locked position. Properly sizing and shaping the tabs so that tabs 32 and second end 22 form a single smooth exterior surface prevents trauma to the user's mouth.

Figure 4:
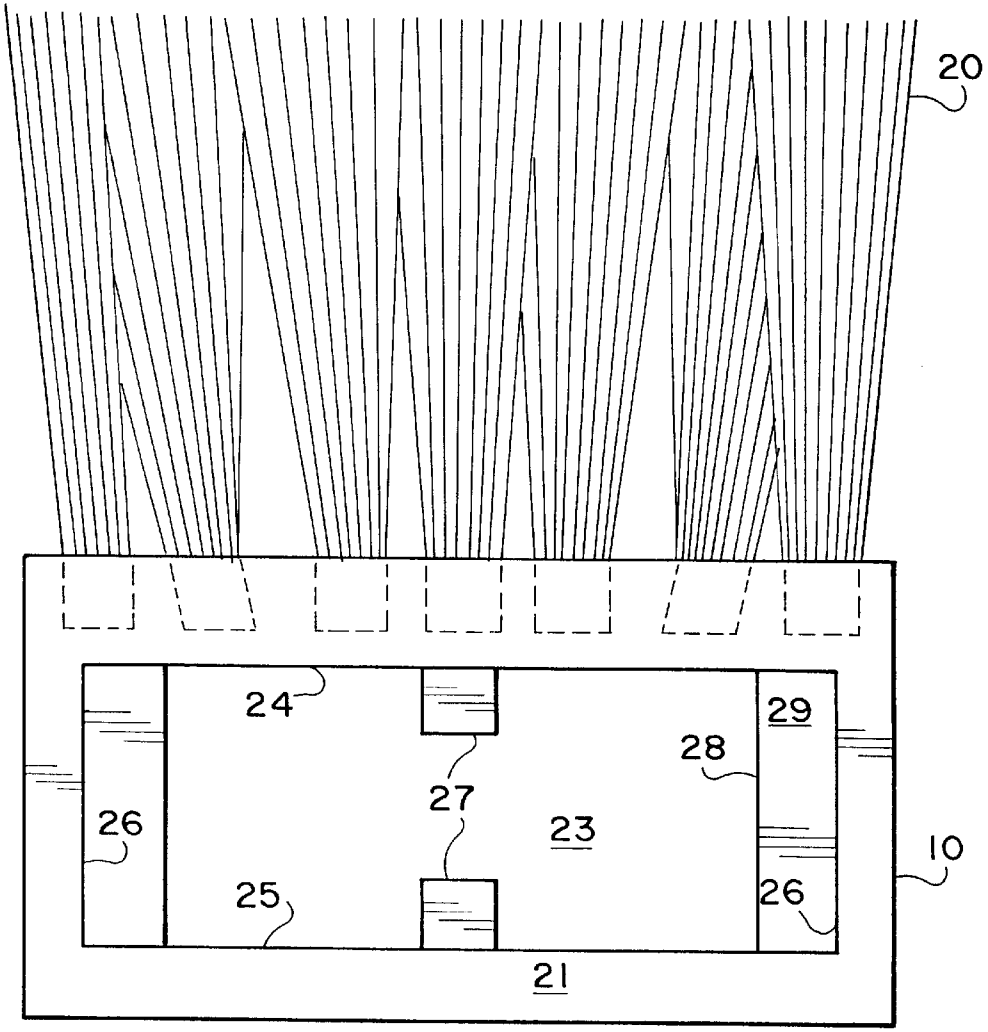
FIG. 4 is a rear view of the bristled cartridge.

FIG. 4 is a rear view of the bristled cartridge 10, clearly depicting the first end 21 thereof. The bristled cartridge 10 has an interior passage 23. The interior passage 23 has a top passage surface 24, a bottom passage surface 25, and a pair of opposing side passage surfaces 26. The top and bottom passage surfaces 24,25 each have an interiorally protruding ridge 27 disposed between the pair of opposing side passage surfaces 26. Each side passage surface 26 has an interiorally protruding vertical lip portion 28 which extends from the top passage surface 24 to the bottom passage surface 25. Each vertical lip portion 28 has an interiorally angled surface 29 generally facing the first end 21. Also, bristles 20 are disposed upon the bristled cartridge 10.

It is to be understood that the present invention is not limited to the sole embodiment described above, but encompasses any and all embodiments within the scope of the following claims.

I claim:

1. A toothbrush having a detachable bristle cartridge, comprising:

a bristled cartridge having an interior passage, said bristled cartridge further including a generally rectangular housing having a first end, a second end and said interior passage running therebetween, said interior passage having a top passage surface, a bottom passage surface and a pair of opposing side passage surfaces, said top and bottom passage surfaces each having an interiorly protruding ridge disposed between said pair of opposing side passage surfaces and extending from said first end to said second end;

a toothbrush handle having a rear end and an attachment end, said attachment end sized to receive said bristle cartridge, said attachment end of said toothbrush handle further including an H-shaped guide sized to receive said interiorly protruding ridges of said top and bottom passage surfaces of said bristle cartridge; and locking means for releasably securing said attached bristled cartridge in position on said toothbrush handle.

2. The toothbrush according to claim 1, wherein:

said pair of opposing side passage surfaces of said bristled cartridge extending from said first end to a preselected distance between said first end and said second end, each side passage surface having an interiorly protruding vertical lip portion extending from said top passage surface to said bottom passage surface, each vertical lip portion having an interiorly angled surface generally facing said first end of said housing and having an interiorly extending locking surface extending normal to said side passage surface and facing said second end of said housing; and said locking means further comprises a pair of deformably rigid tangs disposed upon said attachment end of said toothbrush handle and biased in laterally spaced opposition, each tang having a tip possessing an outwardly extending locking surface sized and disposed for mating with one of said interiorly extending locking surfaces of the side passage surface vertical lip portions, said pair of deformably rigid tangs being sized for and movable between a depressed position for passage through said first end of said interior passage of said bristled cartridge and a biased locking position for releasably securing said attached bristled cartridge in position upon said attachment end of said toothbrush handle.

3. The toothbrush according to claim 1, wherein:

said pair of opposing side passage surfaces of said bristled cartridge extending from said first end to a preselected distance between said first end and said second end;

said locking means further comprises a pair of deformably rigid tangs disposed upon said attachment end of the toothbrush handle and biased in laterally spaced opposition, each tang having a tip possessing an outwardly extending locking surface sized and disposed for mating with one of said interiorly extending locking surfaces of said side passage surface vertical lip portions, said pair of deformably rigid tangs being sized for and movable between a depressed position for passage through said first end of said interior passage of said bristled cartridge and a biased locking position for releasably securing said attached bristled cartridge in position upon said attachment end of said toothbrush handle;

said attachment end of said toothbrush handle further comprises an H-shaped guide positionally disposed between said pair of deformably rigid tangs and sized to receive said interiorly protruding ridges of said top and bottom passage surfaces of said bristle cartridge.

4. The toothbrush according to claim 3, wherein said H-shaped guide and said pair of deformably rigid tangs are pre-sized to be disposed in flush alignment with said second end of said bristled cartridge when said bristled cartridge is attached to said attachment end of said toothbrush handle to prevent trauma to oral tissue.

5. The toothbrush according to claim 1, wherein said toothbrush handle further has a top handle surface and a bottom handle surface, said top handle surface possessing a plurality of thumb depressions spaced apart by a predetermined distance to enable the user to move said toothbrush from one tooth to another without moving the hand in a back and forth motion.

6. The toothbrush according to claim 5 wherein said thumb depressions have a diameter of approximately 10 mm and are interspaced by a distance of 4 mm.

7. The toothbrush according to claim 5, wherein said bottom handle surface possesses at least one finger depression rearward of said thumb depressions to provide better balance and gripping.

8. The toothbrush according to claim 5, wherein said thumb depressions and said finger depressions have a depression depth of 2 mm.

* * * * *